United States Patent [19]

Ball

[11] Patent Number: 4,516,719

[45] Date of Patent: May 14, 1985

[54] WELL SITE DOCUMENT CONTAINER

[76] Inventor: Randell D. Ball, 1141 Elk, Yukon, Okla. 73099

[21] Appl. No.: 524,450

[22] Filed: Aug. 18, 1983

[51] Int. Cl.[3] ..... B65D 91/00

[52] U.S. Cl. ..... 232/1 D; 232/19

[58] Field of Search ..... 232/1 D, 1 E, 19, 20, 232/22, 43.1, 43.5, 45

[56] References Cited

U.S. PATENT DOCUMENTS

| | | | |
|---|---|---|---|
| 1,190,193 | 7/1916 | Rese | 232/22 |
| 1,199,136 | 9/1916 | Westphaln | 232/19 |
| 2,370,682 | 3/1945 | Overmyer | 232/45 |
| 2,578,693 | 12/1951 | Gieseler | 232/19 |
| 2,604,260 | 7/1952 | Brown | 232/19 |
| 3,749,302 | 7/1973 | White | 232/19 |

*Primary Examiner*—Robert P. Swiatek

*Attorney, Agent, or Firm*—E. Harrison Gilbert, III

[57] ABSTRACT

A container for holding a document at a well site comprises a housing having a cavity into which the document can be received. The cavity can be subtantially fluid-tightly sealed by a lid appropriately connected to the housing. The housing has a side in which a window is disposed to enable one to determine whether anything is inside the cavity without having to open the lid. The housing has pairs of holes defined therein so that the housing can be connected to well site structures which are disposed at different angles to the ground.

12 Claims, 4 Drawing Figures

WELL SITE DOCUMENT CONTAINER

BACKGROUND OF THE INVENTION

This invention relates generally to containers for documents and the like at a well site and more particularly, but not by way of limitation, to containers for receiving run tickets at an oil well site.

In operating a well there is the need for some type of container in which papers, notes, pads, clipboards and the like can be retained. Specifically, at an oil well site there is the need for a container in which a run ticket can be placed. A run ticket is generated by an oil hauler who goes to an oil well site with a truck to remove produced oil from storage tanks located at the site. This oil hauling is often done at times when well operating personnel are not present to receive the run tickets which document the quantity of oil taken by the hauler. Therefore, some type of container for the run ticket is needed at the oil well site.

Prior types of containers for run tickets have included glass jars, such as Mason jars or coffee jars. The lids to these jars have sometimes been nailed or otherwise secured to a post at the site so that the jar can be maintained at a specific location by being screwed onto the secured lid.

Although this type of prior container has permitted an oil hauler to leave a run ticket and has enabled the well operator to see if a ticket is present by simply looking through the glass jar, this type has been susceptible to being broken. To replace the broken jars, the operator or the hauler must maintain a supply of properly sized jars. This is a difficult task because the operators and haulers might oversee or go to several sites where jar sizes are different.

Additionally, the jar lids sometimes are not affixed to anything so that the jars can be misplaced.

Another shortcoming of this type of container is that the jars are susceptible to water-leakage and to rusting so that the contents of the jars can be damaged.

Furthermore, use of this type of container is also inconvenient because it takes several seconds to unscrew and screw a jar.

Still another disadvantage of this type of container is that jars are generally not of a size and shape to receive notepads, clipboards or other types of documents other than run tickets which can be folded and inserted into the jars.

Therefore, there is the need for a container which is resistant to being broken and to water-leakage and rusting. There is also the need for such a container to be attachable to different types of equipment, such as stairs, found at well sites, so that the container will not be lost. The container also needs to be constructed so that access can be easily gained without the burden of, for example, screwing and unscrewing a lid from the body of the container. Such a container should also be constructed in a size and shape to enable materials other than run tickets to be received therein.

SUMMARY OF THE INVENTION

The present invention overcomes the above-noted and other shortcomings of the prior art by providing a novel and improved container for documents and the like at a well site. In particular, the present invention provides a container which is resistant to being broken and to water leakage and rusting. The inventive container can be attached to different types of equipment found at well sites. The container includes a lid which is easily opened without screwing or unscrewing. The container is also constructed in a size and shape to enable it to hold materials other than run tickets.

Broadly, the container comprises a substantially planar housing having an open-ended cavity defined therein. The container also includes a lid and means for connecting the lid to the housing so that the lid provides a substantially fluid-tight enclosure to the open-ended cavity when the lid is in a closed position. The lid includes means for biasing the lid towards the closed position. The container further comprises attachment means for enabling the housing to be attached to one of a plurality of structures located at a well site.

Therefore, from the foregoing, it is a general object of the present invention to provide a novel and improved container for retaining documents and the like at a well site. Other and further objects, features and advantages of the present invention will be readily apparent to those skilled in the art when the following description of the preferred embodiment is read in conjunction with the accompanying drawings.

DETAILED DESCRIPTION OF THE PREFERRED EMBODIMENT

Figure 1:
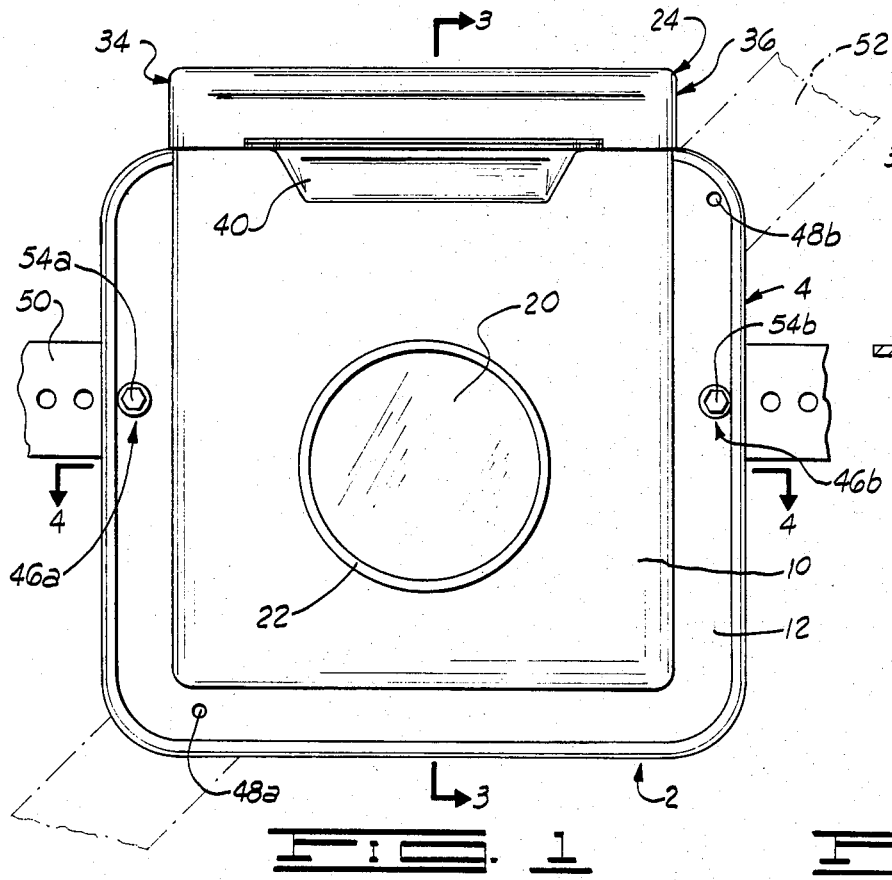
FIG. 1 is a front elevational view of the present invention shown attached to a structural member.
Figure 2:
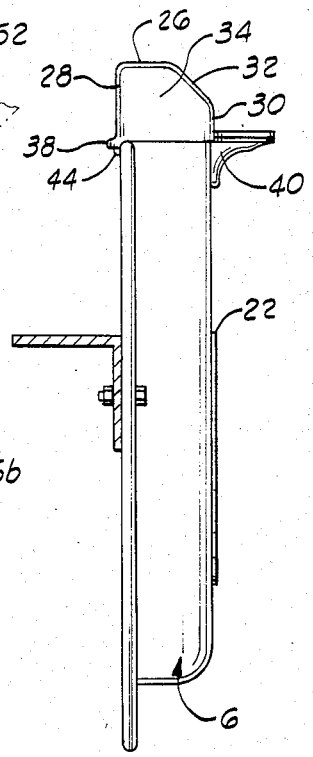
FIG. 2 is a side elevational view of the present invention depicted in FIG. 1.

With reference to the drawings, the preferred embodiment of the present invention will be described. As previously mentioned, the present invention provides a container for holding documents or the like at a well site. These documents can include a run ticket, a clipboard, a notepad or other document which can fit in the inventive container. The container of the preferred embodiment is shown in the drawings and generally identified by the reference numeral 2.

The container 2 includes a housing 4 which in the preferred embodiment is substantially planar in that it is relatively wider and longer than it is deep. The housing 4 of the depicted preferred embodiment includes a first housing member 6 and a separate second housing member 8; however, it is contemplated that the preferred embodiment can be constructed as an integrally formed structure wherein the first and second housing members are molded together.

The illustrated first housing member 6 is a unitary molded plastic structure having a planar front portion 10 bounded over a majority of its perimeter by a flanged edge 12. As shown in FIG. 1, the planar front portion 10 of the preferred embodiment is rectangular with three of the four sides bounded by the flanged edge 12. As also shown in the drawings, the flanged edge 12 includes three linear segments, each of which has a substantially L-shaped cross-section joining with the planar portion 10 at a rounded edge.

Figure 3:
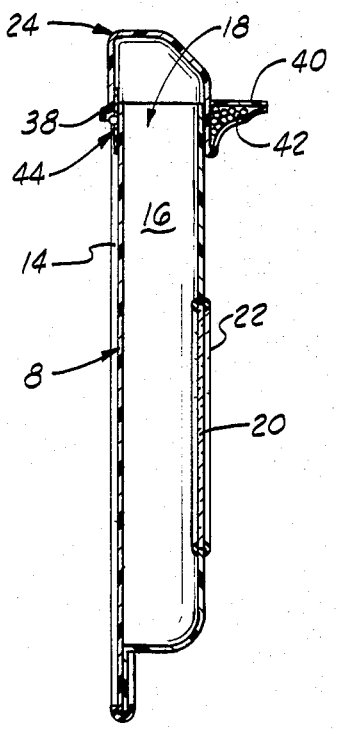
FIG. 3 is a sectional side elevational view of the present invention taken along line 3—3 shown in FIG. 1, but without the structural member.
Figure 4:
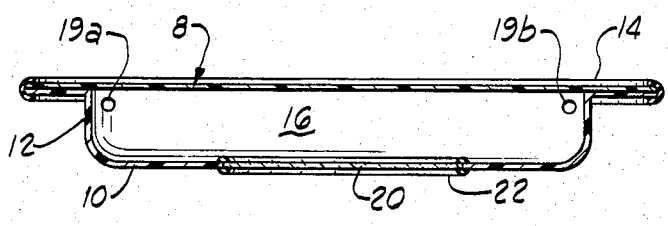
FIG. 4 is a sectional plan view of the present invention taken along line 4—4 shown in FIG. 1.

The second housing member 8 of the illustrated preferred embodiment is a flat molded plastic back or rear element having an edge which fits flush against the back of the outwardly extending legs of the flanged edge 12. The second housing member 8 is attached by suitable means, such as glue, in fluid-tight engagement with the flanged edge 12. As best shown in FIGS. 3 and 4, there is a slight protuberant rim 14 extending rearwardly when the second housing member 8 is attached to the first housing member. In the contemplated embodiment wherein the housing 4 is a single molded structure, it is contemplated that the rim 14 can be eliminated, thereby providing a housing with a flush back with no offsets.

The attachment of the second housing member 8 to the first housing member 6 defines a cavity 16 between the first housing member 6 and the second housing member 8. The cavity 16 has a perimeter defined by the flanged edge 12 and by an open end 18 forming a mouth to the cavity 16. Defined in the leg of the bottom segment of the flanged edge 12 for permitting drainage of fluids which enter the cavity 16 are two drain holes 19*a*, 19*b*. Two holes are defined to insure drainage will occur even if the container 2 is not horizontally mounted.

In the preferred embodiment the cavity 16 has a sufficient width, length and depth to receive a run ticket, a scratch pad, a clipboard or the like. It is, of course, contemplated that the present invention can be made in larger or smaller sizes as the need arises.

Disposed in the planar front portion 10 of the first housing member 6 is a window 20, shown with a circular configuration in the drawings, for providing visual access to the cavity 16 so that it can be determined, at a distance and without moving any portion of the container, whether a document is in the cavity 16. In the preferred embodiment the window 20 is made of clear plastic and is retained in an opening formed in the planar front portion 10 by a molded collar 22 having two channels, one of which receives the edge of the front portion 10 bounding the opening and the other of which receives the edge of the plastic member constituting the window 20 of the preferred embodiment. Other means for providing or retaining a window in the front portion 20 can be utilized; however, it is preferred that such means be substantially fluid-tight to prevent fluid from entering the cavity 16 through the window means.

So that the open end 18 of the cavity 16 can be closed, the container 2 of the present invention also includes a lid 24. In the preferred embodiment the lid 24 includes a molded plastic structure having a top portion 26, a rear portion 28 depending at a substantially right angle from a rear edge of the top portion 26, and a front portion 30 connected to a front edge of the top portion 26 by a beveled portion 32 extending between the top portion 26 and the front portion 30 at obtuse included angles. End portions 34 and 36 of the lid 24 extend to close the ends of the lid 24 as shown in the drawings.

The rear portion 28 has a lower edge 38 which extends rearwardly and downwardly from the main body of the rear portion 28. This lower edge 38 provides stop means for stopping or limiting the degree to which the lid 24 can be pivoted away from its closed position wherein the lid 24 substantially fluid-tightly covers the mouth of the cavity 16. This stop means operates through the abutment of the lower edge 38 with the second housing member 8 when the lid 24 is sufficiently opened.

The front portion 30 and the end portions 34 and 36 have lower edges which are molded to mate with the upper edge of the first housing member 6 so that a substantially fluid-tight engagement results.

Associated with the front portion 30 is a handle 40 which is integrally formed with the lid 24. In the preferred embodiment the handle 40 forms part of a biasing means for tending to pivot the lid 24 towards its closed position wherein the lid 24 and housing 4 are fluid-tightly related. The biasing means of the preferred embodiment also includes weight means, such as a plurality of ball bearing-like elements 42 (see FIG. 3), associated with the handle 40. As shown in FIG. 3, the elements 42 are contained in a hollow interior region of the handle 40.

To attach the lid 24 to the housing 4, the container 2 of the preferred embodiment further includes means for pivotally connecting the lid 24 to the second housing member 8. This means is depicted in the drawings as a hinge 44. As shown in FIG. 3, the hinge 44 is mounted so that the portion thereof defining the axis of pivotation is disposed within a channel defined by the lower edge 38. This construction further enhances the fluid-tightness of the inventive container by reducing the opportunity for fluid to enter the cavity 16 through the hinge 44.

The container 2 also includes attachment means for enabling the housing 4 to be attached to one of a plurality of structures located at a well site, particularly an oil well site in the preferred embodiment. As shown in the drawings, the preferred embodiment of the attachment means includes two pairs of complementary holes defined in the first and second housing members 6, 8. One of these pairs is identified in the drawings by the reference numerals 46*a*, 46*b* which indicate the location of the holes, and the other of these pairs is identified by the reference numerals 48*a*, 48*b*.

The pair of holes 46*a*, 46*b* lies on, or defines, a line which extends at a first angular relationship to the housing 4, which relationship in the illustrated preferred embodiment can be defined as substantially parallel to the axis of pivotation provided by the hinge 44. This permits the housing 4 to be mounted to a structure having a first angle relative to the ground at the well site. For example, the structure could be a horizontal strut 50 of a stairway as partially illustrated in FIG. 1.

The pair of holes 48*a*, 48*b* lies on, or defines, a line extending at an acute angle to the line of the pair 46*a*. 46 and, therefore, at a second angular relationship to the housing 4. This other pair of holes enables the housing 4 to be mounted on a structural member which extends at an angle (e.g., approximately 45° in the preferred embodiment) between horizontal and vertical. This structural member could be a strut 52 (in dot-dash line in FIG. 1) extending parallel to the flight of stairs of a stairway found at the well site.

In using the present invention, the housing 4 is mounted at the well site by suitable fastening means, such as nuts and bolts (generally illustrated in FIG. 1 by elements 54*a*, 54*b*), passing through a respective one of the pairs of holes. Once the housing 4 is attached, it can be used to store or receive run tickets and other documents. These are stored or received through the mouth of the cavity 16 when the lid 24 is pivoted away from its closed position. Once the document is placed in or removed from the cavity 16, the lid 24 is pivoted to its closed position and maintained, through the operation of the biasing means, in its closed position to afford a fluid-tight engagement whereby the cavity 16 is maintained dry. Should the lid 24 be left open whereby fluid, such as rain, can enter the cavity 16, the fluid will drain through one or both of the holes 19*a*. 19*b*.

By mounting the housing 4 so that the window 20 faces a road providing access to the well site, one can determine if there is anything in the cavity by merely driving up to the well site and looking through the window 20 without having to get out of the vehicle or otherwise approach the container 2 or to open the lid 24.

Thus, the present invention is well adapted to carry out the objects and attain the ends and advantages mentioned above as well as those inherent therein. While a preferred embodiment of the invention has been described for the purpose of this disclosure, numerous changes in the construction and arrangement of parts can be made by those skilled in the art, which changes are encompassed within the spirit of this invention as defined by the appended claims.

What is claimed is:

1. A container for holding an object at a well site, comprising:

a substantially planar housing having an open-ended cavity defined therein for receiving said object and having a flanged edge portion extending adjacent at least a portion of said cavity;

a window disposed in said housing so that said object can be seen at a distance from said housing when said object is disposed in said cavity;

a lid;

means for connecting said lid to said housing so that said lid provides a substantially fluid-tight enclosure to said open-ended cavity when said lid is in a closed position; and attachment means in said flanged edge portion for enabling said housing to be attached to a plurality of structures at said well site, said structures including a horizontal strut and an angular strut, said attachment means including a first pair of holes defined in said edge portion near opposite corners thereof so that said first pair of holes defines a line parallel to said angular strut and said attachment means further including a second pair of holes defined in said edge portion and spaced from said first pair of holes so that said second pair of holes defines a line parallel to said horizontal strut.

2. A container as defined in claim 1, wherein said lid includes a handle having weight means for biasing said lid towards said closed position.

3. A container as defined in claim 1, wherein said housing includes a planar front portion, a flanged edge extending along a substantial length of the perimeter of said planar front portion, and a planar back portion associated with said flanged edge.

4. A container as defined in claim 3, wherein said flanged edge has a hole defined therein for permitting fluid drainage from said cavity.

5. A container as defined in claim 1, wherein:

said means for connecting said lid to said housing includes a hinge, connected to said housing and said lid, having a portion defining an axis of pivotation about which said lid is pivotable; and said lid includes a rear portion having a lower edge defining a channel in which said axis-defining portion of said hinge is disposed so that the opportunity for fluid entering said cavity through said hinge is reduced.

6. A container as defined in claim 5, wherein said lid further includes:

a top portion from which said rear portion depends;

a front portion; and a beveled portion connecting said front portion to said top portion.

7. A container for holding an object at a well site having located thereat an assembly with one or both of a horizontal strut and an angular strut, said container comprising:

a molded first housing member having a substantially planar portion bounded over a majority of its perimeter by a flanged edge;

a second housing member attached in fluid-tight engagement with said flanged edge so that a cavity having a perimeter defined by said flanged edge is defined between said first housing member and said second housing member;

a window disposed in said first housing member;

a lid having a molded edge for fluid-tightly engaging said planar portion and said flanged edge of said first housing member when said lid is placed in a closed position;

a handle, attached to said lid, including weight means for biasing said lid towards its closed position;

means for pivotally connecting said lid to said second housing member; and attachment means for enabling said housing members to be attached to one of said horizontal strut or said angular strut, said attachment means including a first pair of holes defined in said flanged edge so that said first pair of holes defines a line parallel to said angular strut and said attachment means further including a second pair of holes defined in said flanged edge and spaced from said first pair of holes so that said second pair of holes defines a line parallel to said horizontal strut.

8. A container for holding a document at a well site, comprising:

a housing having a cavity defined therein for receiving said document, said housing including:

a first housing member having a substantially planar portion bounded over at least a part of its perimeter by a flanged edge; and a second housing member attached to said flanged edge so that said cavity is defined between said first housing member and said second housing member;

a window disposed in said housing in communication with said cavity so that said document can be seen at a distance from said housing when said document is disposed in said cavity;

a lid having an edge for engaging said planar portion and said flanged edge of said first housing member when said lid is placed in a closed position;

means for associating said lid with said housing; and attachment means for enabling said housing to be attached to a selectable one of a plurality of structures located at said well site, each of said structures being disposed at a different angle relative to the ground at said well site, said attachment means including a first pair of holes defined in said flanged edge so that said first pair of holes defines a line parallel to a first one of said structures and said attachment means further including a second pair of holes defined in said flanged edge and spaced from said first pair of holes so that said second pair of holes defines a line parallel to a second one of said structures, said second one of said structures being disposed at a different angle than is said first one of said structures.

9. A container as defined in claim 8, wherein:

said means for associating said lid with said housing includes a hinge, connected to said housing and said lid, having a portion defining an axis of pivotation about which said lid is pivotable; and said lid includes a rear portion having a lower edge defining a channel in which said axis-defining portion of said hinge is disposed so that the opportunity for fluid entering said cavity through said hinge is reduced.

10. A container as defined in claim 9, wherein said lid further includes:

a top portion from which said rear portion depends;

a front portion; and a beveled portion connecting said front portion to said top portion.

11. A container for holding a run ticket at an oil well site having located thereat a stairway assembly with one or both of a horizontal strut and an angular strut, said angular strut extending parallel to a flight of stairs of said stairway assembly, said container comprising:

a molded first housing member having a substantially planar portion bounded over a majority of its perimeter by a flanged edge;

a second housing member attached in fluid-tight engagement with said flanged edge so that a cavity having a perimeter defined by said flanged edge is defined between said first housing member and said second housing member;

a window disposed in said first housing member so that said run ticket can be seen at a distance from said first housing member when said run ticket is disposed in said cavity;

a lid having a molded edge for fluid-tightly engaging said planar portion and said flanged edge of said first housing member when said lid is placed in a closed position; and attachment means for enabling said housing members to be attached to one of said horizontal strut or said angular strut, said attachment means including a first pair of holes defined in said flanged edge near opposite corners thereof so that said first pair of holes defines a line parallel to said angular strut and said attachment means further including a second pair of holes defined in said flanged edge and spaced from said first pair of holes so that said second pair of holes defines a line parallel to said horizontal strut.

12. A container as defined in claim 11, further comprising a handle, attached to said lid, having a hollow interior region defined therein for receiving ball bearing members so that said handle biases said lid towards its closed position.

* * * * *